US008388360B1

(12) United States Patent
Brewer

(10) Patent No.: US 8,388,360 B1
(45) Date of Patent: Mar. 5, 2013

(54) SPARK PLUG WIRE

(76) Inventor: Jerry Brewer, Lumberton, NC (US)

( * ) Notice: Subject to any disclaimer, the term of this patent is extended or adjusted under 35 U.S.C. 154(b) by 0 days.

(21) Appl. No.: 13/253,152

(22) Filed: Oct. 5, 2011

(51) Int. Cl.
*H01R 13/44* (2006.01)

(52) U.S. Cl. ..... 439/125

(58) Field of Classification Search ..... 439/125–128
See application file for complete search history.

(56) References Cited

U.S. PATENT DOCUMENTS 2,321,782 A * 6/1943 Von Mertens ..... 439/127
4,125,938 A * 11/1978 Clark ..... 29/764
4,193,651 A * 3/1980 Hays ..... 439/502
5,001,431 A * 3/1991 Garasimowicz et al. ..... 439/175

* cited by examiner

*Primary Examiner* — Briggitte R Hammond

(57) ABSTRACT

A spark plug wire having a first terminal and a second terminal wherein the first terminal is configured to operably couple to a distributor of a combustion engine and the second terminal operably couples to a spark plug. The second terminal further includes a housing that is generally cylindrical in shape having an upper groove and a lower groove. A first lateral ring is surroundably mounted to the housing within the upper groove. A second lateral ring is surroundably mounted to the housing within the lower groove. A first grip member and a second grip member being elongated in shape having a first end and a second end are integrally connected to the first lateral ring and the second lateral ring. The first grip member and second grip member are mounted such that they are diametrically opposed on the housing.

19 Claims, 2 Drawing Sheets

SPARK PLUG WIRE

FIELD OF THE INVENTION

The present invention relates to spark plug wires, more specifically but not by way of limitation a spark plug wire having a terminal body operable to releasably secure to a spark plug that further includes a gripping means so as to facilitate easier removal of the spark plug wire terminal body from the spark plug.

BACKGROUND

Internal combustion engines obtain their power from a combination of heat and pressure produced by the combustion of an air-fuel mixture inside a cylinder disposed within the block of the engine. Conventional combustion engines utilize a spark to ignite the air-fuel mixture that has been introduced into the cylinder. Typical ignition systems for a combustion engine include a battery, distributor, ignition switch, spark plug wires and spark plugs. The spark plugs are releasably secured into the cylinder having a portion that ignites the air-fuel mixture through a production of timed sparks between the spark plugs electrodes subsequent a received ignition voltage.

The spark plug wires are typically manufactured so as to electrically couple the spark plug with the distributor. The routing of the spark plug wires from the distributor to each spark plug of the internal combustion engine typically involves the passage of the wire such that the spark plug wires are adjacent high heat sources such as but not limited to exhaust manifolds or headers. Conventional internal combustion engines will typically experience failure with the spark plug wires as the wires prematurely fail due to heat fatigue. The failure of the spark plug wires has shown to lead to engine malfunctions which inconveniences the owner and can result in a costly repair expense.

One problem with existing spark plug wires is that their terminal body that is releasably secured to the portion of the spark plug extending from the cylinder is terminal body can often crack and separate after prolonged exposure to the heat of the engine. The terminal body is typically adjacent the engine block and is further proximate a high heat source such as an exhaust manifold. As part of routine maintenance, vehicle owners will periodically change the spark plugs. During the changing of the spark plugs, the terminal body of the spark plug wire is often grasped and pulled so as to release the terminal body from the spark plug. Often, as a result of exposure to high heat, the terminal body cracks or disintegrates, which requires the entire sparkplug wire to be replaced creating a greater expense for the owner.

Accordingly, there is a need for a spark plug wire that has a terminal body that includes at least one gripping means that is constructed to endure prolonged exposure to heat and will facilitate an improved de-coupling of the terminal body from the spark plug so as to substantially avoid damage to the terminal body.

SUMMARY OF THE INVENTION

It is the object of the present invention to provide a spark plug wire that includes a terminal body operable to releasably secure to a spark plug that is resistant to heat fatigue.

Another object of the present invention is to provide a spark plug wire having a terminal body that further includes a gripping means so as to facilitate the engagement and removal of the terminal body from the spark plug.

Yet a further object of the present invention is to provide a spark plug wire having a terminal end wherein the gripping means comprises of two diametrically opposed loops that are integrally formed with the terminal body of the spark plug wire.

Still another object of the present invention is to provide a spark plug wire that has a terminal body that further includes an upper groove and lower groove formed to engage lateral support members of the diametrically opposed loops.

An additional object of the present invention is to provide a spark plug wire having a terminal body wherein the diametrically opposed loops are manufactured so as to be substantially resistant to heat fatigue.

Yet another object of the present invention is to provide a spark plug wire that includes a terminal body that is easy to remove without the need for special tooling.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
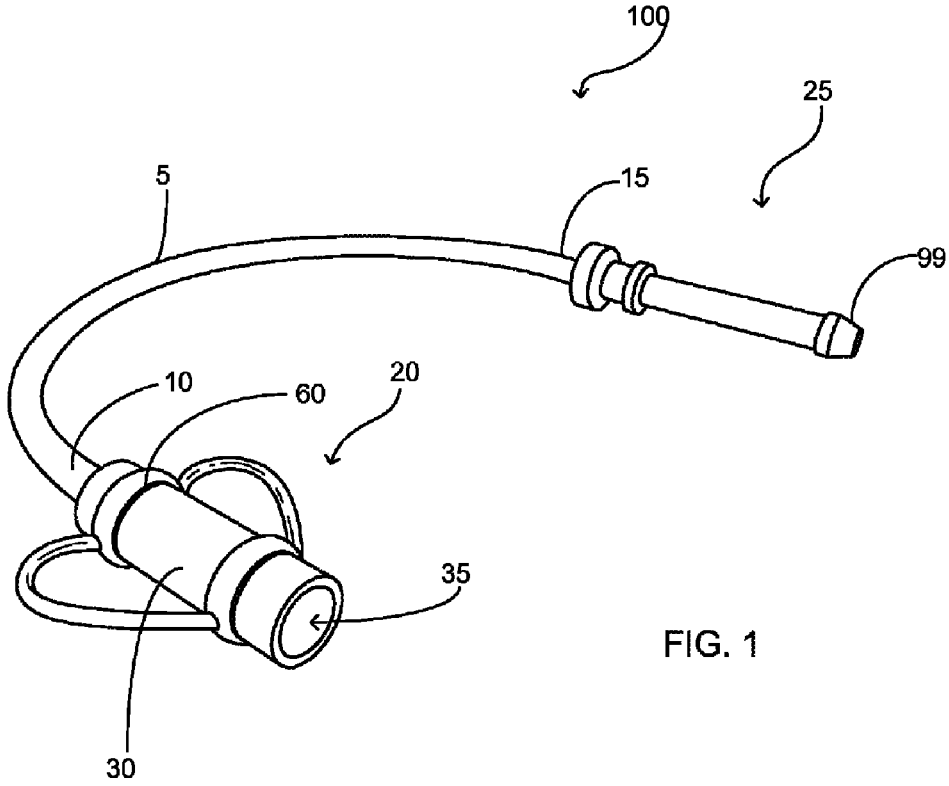
FIG. 1 is a perspective view of the preferred embodiment of the present invention.
Figure 2:
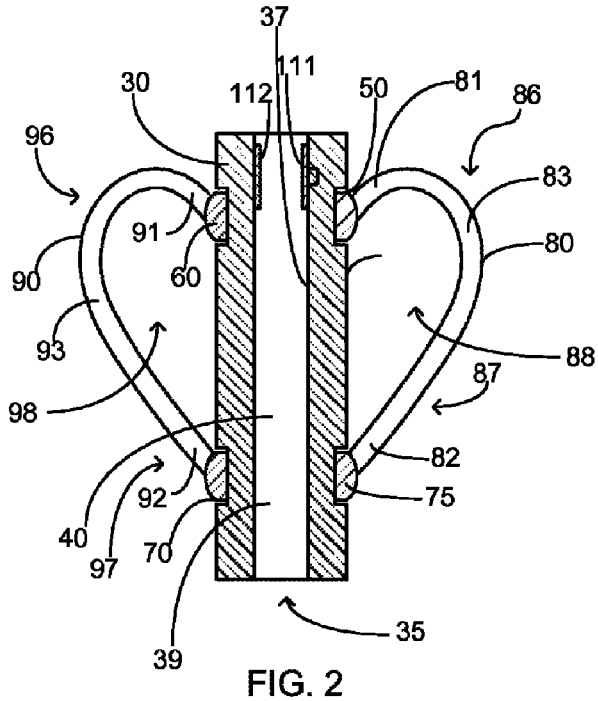
FIG. 2 is a cross-sectional view of the preferred embodiment of the present invention.
Figure 3:
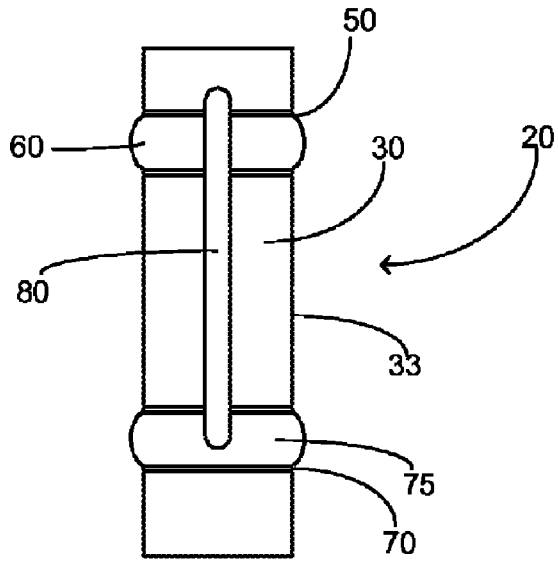
FIG. 3 is a side view of the terminal body of the preferred embodiment of the present invention.

Referring now to the drawings submitted herewith, wherein various elements depicted therein are not necessarily drawn to scale and wherein through the views and figures like elements are referenced with identical reference numerals, there is illustrated a spark plug wire 100 constructed according to the principles of the present invention.

As shown in particular in FIG. 1, the spark plug wire 100 further includes body 5 being generally elongated in shape having a first end 10 and a second end 15. The body 5 is manufactured from a generally flexible material that is substantially resistant to heat such as but not limited to silicon rubber. The body 5 has disposed therein a conductor material (not illustrated herein) similar to a conventional spark plug wire that functions to electrically couple the first terminal 20 with the second terminal 25. It is contemplated within the scope of the present invention that the body 5 could be manufactured in any suitable length and utilize numerous different conductive materials to so as to electrically couple the first end 20 and the second end 25.

The first terminal 20 includes a housing 30 that is generally cylindrical in shape having an aperture 35 distal to the first end 10 of the body 5. The housing 30 is manufactured from a suitable heat resistant material such as but not limited to thermoplastic or silicon rubber. While no particular length of the housing is required, good results have been achieved utilizing a housing 30 that is approximately four inches in length. The housing 30 further includes a cavity 40 that is generally cylindrical in shape functioning to receive a conventional spark plug therein. While the cavity 40 has been disclosed herein as being generally cylindrical in shape, it is contemplated within the scope of the present invention that the cavity 40 could be formed so as to mateably couple with the ceramic end of a conventional spark plug. The first terminal 20 functions to surroundably mount the ceramic end of a conventional spark plug that is operably coupled to an internal combustion engine. Disposed within the cavity 40 are conductor plates 111, 112. The conductor plates 111,112 are secured to the interior wall 37 of the cavity 40 utilizing suitable methods and function to releasably secure to a conventional conductor post of a spark plug. The conductor plates 111, 112 are manufactured from a suitable conductive material and function to electrically couple a spark plug secured to the first terminal 20 body 5.

A first groove 50 is located on the exterior surface 33 of the housing 30. The first groove 50 is generally a square shaped groove that encircles the housing 30 entirely. The first groove 50 functions to receive and substantially secure the first lateral ring 60. The first groove 50 is located proximate the second end 39 of the housing 30. It is contemplated within the scope of the present invention that the first groove 50 could be formed in various sizes so as to accommodate the first lateral ring 60 and provide securing thereof.

The housing 30 further includes a second groove 70 formed into the exterior surface 33. The second groove 70 completely encircles the housing 30 and is generally square u-shaped. The second groove 70 functions to receive and substantially secure the second lateral ring 75. The second groove 70 is located proximate the first end 37 of the housing 30. It is contemplated within the scope of the present invention that while the second groove has been disclosed herein as being generally square u-shaped, that the second groove 70 could be manufactured in various different shape grooves so as to mateably and securely receive the second lateral ring 75. The first lateral ring 60 and the second lateral ring 75 are manufactured from a durable heat resistant material and are shaped so as to mateably couple with the first groove 50 and second groove 70 respectively. The first lateral ring 60 and second lateral ring 75 function to transfer any pulling force applied to the first loop 80 and second loop 90 circumferentially around the housing 30 such that the first terminal 20 can be easily released from a conventional spark plug. While no particular internal diameter of the first lateral ring 60 is required, good results have been achieved utilizing an internal diameter of approximately 0.861 inches.

A first loop 80 is secured to the first lateral ring 60 and the second lateral ring 75. The first loop 80 includes ends 81, 82 that are integrally formed with the first lateral ring 60 and second lateral ring 75 respectively. The first loop 80 includes member 83 that is generally rod-shaped and is formed such that an upper portion 86 extends outward from the housing 30 at a distance that is greater than that of the lower portion 87. The first loop 80 is formed with the first lateral support ring 60 and the second lateral support ring 75 so a to create a void 88 intermediate the member 83 and the exterior surface 33 of the housing 30. The void 88 is of suitable size to accommodate therein at least one human finger to allow a user to grasp the first loop 80 so as to release the first terminal 20 from a conventional spark plug. The member 83 is manufactured from a suitable heat resistant material. While not illustrated herein, it is contemplated within the scope of the present invention that the member 83 further includes an interior core manufactured from a resilient metal that provides structural support for the first loop 80. The interior core extends intermediate end 81, 82 and increases the rigidity of the first loop 80 in addition to providing further leverage during the process of releasing the first terminal 20 from a conventional spark plug.

The second loop 90 is secured to the first lateral ring 60 and the second lateral ring 75 on the opposing side of the housing 30 from the first loop 80. The second loop 90 includes ends 91,92 that are integrally formed with the first lateral ring 60 and second lateral ring 75 respectively. The second loop 90 includes member 93 that is generally rod-shaped and is formed such that an upper portion 96 extends outward from the housing 30 at a distance that is greater than that of the lower portion 97. The second loop 90 is formed with the first lateral support ring 60 and the second lateral support ring 75 so as to create a void 98 intermediate the member 93 and the exterior surface 33 of the housing 30. The void 98 is of suitable size to accommodate therein at least one human finger to allow a user to grasp the second loop 90 so as to release the first terminal 20 from a conventional spark plug. The member 93 is manufactured from a suitable heat resistant material. While not illustrated herein, it is contemplated within the scope of the present invention that the member 93 further includes an interior core manufactured from a resilient metal that provides structural support for the second loop 90. The interior core extends intermediate end 91,92 and increases the rigidity of the second loop 90 while additionally providing increased leverage during the process of releasing the first terminal 20 from a conventional spark plug.

It is contemplated within the scope of the present invention that the first loop 80 and second loop 90 could be formed in numerous different shapes in addition to the shape disclosed herein and provide the function of an interface to remove the first terminal 20 from a conventional spark plug. Additionally while a first loop 80 and a second loop 90 have been disclosed in the preferred embodiment of the invention, it is contemplated within the scope of the present invention that the housing 30 could have as few a one loop secured thereto configured for the purpose of providing increased leverage during the process of removing the first terminal 20 from a conventional spark plug.

Integrally attached to the second end 15 is the second terminal 25. The second terminal 25 functions to electrically engage conventional distributor or other voltage distribution device. The second end 25 receives a voltage from a distributor and transmits the voltage to the body 5, which transfers the voltage to the first terminal 20. The second terminal includes receiver 99 designed to be mateably connected with an electrical distribution system. It is contemplated within the scope of the present invention that he second terminal 25 could be formed in numerous different shapes so as to mateably connect with a conventional distributor or electrical distributing system of a vehicle.

Figure 4:
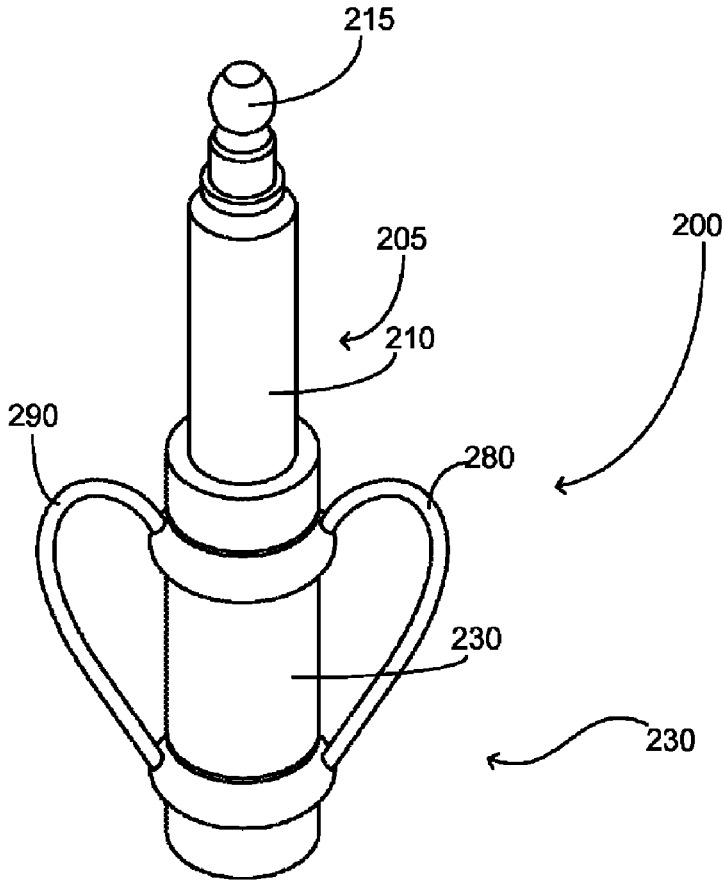
FIG. 4 is a perspective view of an alternative embodiment of the present invention.

An alternative embodiment of the present invention is illustrated in particular in FIG. 4. In the alternative embodiment, a terminal 200 is provided and constructed identically to the first terminal 20 as previously discussed herein having a housing 230, first loop 280, second loop 290. The terminal 200 further includes a conductive post 205 configured to mateably couple to a conventional spark plug wire. The conductive post includes an insulated body 210 that is integrally secured to the housing 230 utilizing suitable methods. A conductor knob 215 is formed with the insulated body 210 distal to the housing 230. The conductor knob 215 is electrically coupled to the lower portion 230 of the terminal 200. The terminal 200 is placed such that it is operably intermediate a spark plug of a internal combustion engine and the spark plug wire of the electrical harness system in order to facilitate removal of the spark plug wire without the need for tools and substantially reducing any potential damage to the spark plug wire.

Referring in particular to FIG. 1, a description of the operation of the spark plug wire 100 is as follows. In use, the user will operably connect the second terminal 25 to a distributor or electrical distribution system of an internal combustion engine. The first terminal 20 will be releasably secured to a spark plug operably couple with the internal combustion engine. The conductor plates 111, 112 will electrically engage the spark plug and transfer the voltage thereto. When a user is engaged in maintenance of the engine and the maintenance requires the removal of a spark plug, the user will grasp the first loop 80 and the second loop 90 and apply a pulling force so as to release the connection between the first terminal 20 and the spark plug. As the pulling force is applied, the first lateral ring 60 and second lateral ring 75 transfer the pulling force in a general circumferential direction so as to facilitate the easier removal of the first terminal from the spark plug.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A spark plug wire comprising:

a body, said body being generally elongated in shape and flexible, said body having a conductive core, said body having a first end and a second end;

a first terminal, said first terminal proximate said first end of said body, said first terminal including a housing, said housing being generally cylindrical in shape, said housing having a cavity operable to accommodate a portion of a spark plug, said housing further including at least one groove, said at least one groove being circumferentially located around said housing;

a second terminal, said second terminal proximate said second end of said body, said second terminal electrically coupled with said first terminal, said second terminal configured to mateably connect with a distributor of an internal combustion engine;

at least one lateral ring, said lateral ring suroundably mounted to said housing, said at least one lateral ring being disposed within said at least one groove, at least one loop, said at least one loop operably connected to said at least one lateral ring, said at least one loop having a void sufficient to accommodate at least one human finger therein, said at least one loop for providing leverage to release said first terminal from a spark plug.

2. The spark plug wire as recited in claim 1, wherein said at least one loop further includes a rigid core.

3. The spark plug wire as recited in claim 2, wherein said at least one loop includes an outer layer, said outer layer being a heat resistant material.

4. The spark plug wire as recited in claim 3, wherein said at least one groove is generally square u-shaped.

5. The spark plug wire as recited in claim 4, wherein said at least one loop further includes a first portion and a second portion, said first portion configured to extend away from said housing at a distance greater than said second portion.

6. The spark plug wire as recited in claim 5, wherein the internal diameter of said at least one lateral ring is approximately 0.861 inches.

7. The spark plug wire as recited in claim 6, and further including at least one conductor plate, said at least one conductor plate being disposed within said cavity, said at least one conductor plate for electrically engaging a spark plug.

8. A spark plug wire interface having a first end and a second end wherein the spark plug wire interface is operable to receive a terminal of a conventional spark plug wire on the first end and operably engage a spark plug on the second end comprising:

a body, said body being generally cylindrical in shape, said body having a first end and a second end, said body having a hollow portion configured to receive a portion of a spark plug therein, said body further including an upper groove and a lower groove, said upper groove being proximate said first end of said body, said lower groove being proximate said second end of said body;

a first lateral ring, said first lateral ring surroundably mounted to said body, said first lateral ring being disposed within said upper groove;

a second lateral ring, said second lateral ring surroundably mounted to said body, said second lateral ring being disposed within said lower groove;

a first loop, said first loop having a first end and a second end, said first end of said first loop being secured to said first lateral ring, said second end of said first loop being secured to said second lateral ring, said first loop extending away from said body, said first loop forming a void intermediate said body and said first loop.

9. The spark plug wire interface as recited in claim 8, and further including a second loop, said second loop having a first end and a second end, said first end of said second loop being mounted to said first lateral ring on the opposing side of the body from said first end of said first loop, said second end of said second loop being secured to said second lateral ring on the opposing said of the body from said second end of said first loop.

10. The spark plug wire interface as recited in claim 9, and further including a conductor post, said conductor post being integrally secured to said first end of said body, said conductor post configured to electrically couple with a terminal of a spark plug wire.

11. The spark plug wire interface as recited in claim 10, wherein said conductor post further includes a knob, said knob being generally rounded in shape, said knob distal from said body.

12. The spark plug wire interface as recited in claim 11, wherein said first loop and said second loop further include a core member, said core member being manufactured from a heat resistant metal, said core member providing structural support for said first loop and said second loop.

13. The spark plug wire interface as recited in claim 12, wherein a portion of said conductor post further includes an electrically insulating layer.

14. A spark plug wire operable to electrically couple a spark plug of an internal combustion engine with a distributor, the spark plug wire having a first end and a second end wherein the second end operably engages a portion of the spark plug and is configured for easier removal thereof comprising:

a wire body, said wire body being generally elongated in shape and flexible, said body having a conductive core, said wire body operable to transmit voltage, said wire body having a first end and a second end;

a first terminal, said first terminal integrally formed with said first end of said wire body, said first terminal electrically coupled with a distributor of an internal combustion engine a second terminal, said second terminal integrally formed with said second end of said wire body, said second terminal including a housing, said housing being generally cylindrical in shape, said housing having a first end and a second end, said first end of said housing being integrally formed with said second end of said wire body, said housing further including an opening, said opening proximate said second end of said housing, said housing having a cavity operable to accommodate a portion of a spark plug, said housing further including an upper groove, said upper groove proximate said first end of said housing, said housing further including a lower groove said lower groove proximate said second end of said housing;

a first lateral ring, said first lateral ring surroundably mounted to said body, said first lateral ring being disposed within said upper groove;

a second lateral ring, said second lateral ring surroundably mounted to said body, said second lateral ring being disposed within said lower groove;

a first grip member, said first grip member having a first end and a second end, said first end of said first grip member securely attached to said first lateral ring, said second end of said first grip member securely attached to said second lateral ring, said first grip member extending away from said housing wherein a void exists between said first grip member and said housing, said void being of suitable size to accommodate at least one human finger therein.

15. The spark plug wire as recited in claim 14, and further including a second grip member, said second grip member having a first end and a second end, said first end of said second grip member being mounted to said first lateral ring diametrically opposite said first end of said first grip member, said second end of said second grip member being secured to said second lateral ring diametrically opposite said second end of said first grip member, said second grip member extending away from said housing wherein a void exists between said second grip member and said housing, said void being of suitable size to accommodate at least one human finger therein.

16. The spark plug wire as recited in claim 15, wherein said first grip member further includes an upper portion and a lower portion, said upper portion extending away from said housing at a distance greater than said lower portion.

17. The spark plug wire as recited in claim 16, wherein said second grip member further includes an upper portion and a lower portion said upper portion extending away from said housing at a distance greater than said lower portion.

18. The spark plug wire as recited in claim 17, wherein said first grip member and said second grip member are manufactured from a heat resistant material.

19. The spark plug wire as recited in claim 18, wherein said upper groove and said lower groove are square u-shaped.

* * * * *